US007276320B2

(12) United States Patent
Kmiecik-Lawrynowicz et al.

(10) Patent No.: US 7,276,320 B2
(45) Date of Patent: Oct. 2, 2007

(54) SURFACE PARTICLE ATTACHMENT PROCESS, AND PARTICLES MADE THEREFROM

(75) Inventors: Grazyna E. Kmiecik-Lawrynowicz, Fairport, NY (US); Maura A. Sweeney, Irondequoit, NY (US); Robert D. Bayley, Fairport, NY (US); Ronald J. Koch, Webster, NY (US); Mary L. McStravick, Fairport, NY (US); Daniel W. Asarese, Honeoye Falls, NY (US)

(73) Assignee: Xerox Corporation, Stamford, CT (US)

( * ) Notice: Subject to any disclaimer, the term of this patent is extended or adjusted under 35 U.S.C. 154(b) by 393 days.

(21) Appl. No.: 11/037,215

(22) Filed: Jan. 19, 2005

(65) Prior Publication Data

US 2006/0160007 A1 Jul. 20, 2006

(51) Int. Cl.
*G03G 9/08* (2006.01)

(52) U.S. Cl. ..... 430/108.3; 430/108.4; 430/108.6; 430/110.1; 430/137.14

(58) Field of Classification Search ..... 430/108.3, 430/108.4, 108.6, 110.1, 137.14
See application file for complete search history.

(56) References Cited

U.S. PATENT DOCUMENTS

| | | | |
|---|---|---|---|
| 3,674,736 | A | 7/1972 | Lerman et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,482,812 | A | 1/1996 | Hopper et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |

(Continued)

OTHER PUBLICATIONS

U.S. Appl. No. 10/902,068, filed Jul. 30, 2004, Stravick et al.

*Primary Examiner*—John L Goodrow
(74) *Attorney, Agent, or Firm*—Oliff & Berridge, PLC

(57) ABSTRACT

A method of forming toner particles having surface particles attached thereto includes the steps of aggregating a material of at least one binder material and at least one colorant to produce toner particles, following aggregation, forming a mixture of the surface particles and the toner particles, and subjecting the mixture to a temperature above the glass transition temperature of the toner particles to coalesce the toner particles, whereby the surface particles become at least partially embedded within the surface of the toner particles. Toner particles prepared by such method include a core comprised of at least one binder and at least one colorant, and surface particles at an external surface of the toner particles, wherein at least about 50% of the surface particles are substantially completely covered by a portion of binder and a majority of the surface particles protrude from the toner particle surface a distance of at least 50% of the average particle size of the surface particles.

19 Claims, 3 Drawing Sheets

U.S. PATENT DOCUMENTS 5,593,807 A 1/1997 Sacripante et al.
5,622,806 A 4/1997 Veregin et al.
5,650,255 A 7/1997 Ng et al.
5,650,256 A 7/1997 Veregin et al.
5,716,752 A 2/1998 Ott et al.
5,723,253 A 3/1998 Higashino et al.
5,744,520 A 4/1998 Kmiecik-Lawrynowicz et al.
5,747,215 A 5/1998 Ong et al.
5,763,132 A 6/1998 Ott et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,922,501 A 7/1999 Cheng et al.
5,925,488 A 7/1999 Patel et al.
5,945,245 A 8/1999 Mychajlowskij et al.
5,977,210 A 11/1999 Patel et al.
5,981,129 A * 11/1999 Akazawa et al. ..... 430/110.2
6,210,853 B1 4/2001 Patel et al.
6,395,445 B1 5/2002 Toth et al.
6,503,680 B1 1/2003 Chen et al.
6,627,373 B1 9/2003 Patel et al.
7,157,199 B2 * 1/2007 Emoto et al. ..... 430/108.22
2004/0131961 A1 * 7/2004 Watanabe et al. ..... 430/108.4

* cited by examiner

SURFACE PARTICLE ATTACHMENT PROCESS, AND PARTICLES MADE THEREFROM

BACKGROUND

The subject matter described herein relates mainly to toner and developer compositions, and more specifically, to toner and developer compositions that are made to have particles, preferably spacer particles, attached firmly to the toner particle surface. Also described is a method of firmly attaching such surface particles to the surface of the toner particles in-situ (i.e., during formation of the toner particles).

The use of spacer particles upon the surface of toner particles is known in the art. Spacers can be employed for a number of reasons in that the spacers typically decrease toner particle adhesion and cohesion. The spacers can improve toner flow, charging, development and transfer during the xerographic process. A particular advantage associated with the use of spacer particles upon the toner particle surface is that the spacer particles act to protect the toner particles from the high amount of abuse the toner particles receive in the developer housing. In the developer housing, the toner particles are constantly impacted by other toner particles and by carrier particles. Such impaction can, over time, embed smaller surface additives, change the charging properties, and thus the transfer quality, of the toner particles. One theory is that this reduction in performance over time is due to the impaction of small conventional toner surface additives of, for example, a size of from about 5 to about 40 nanometers, such as silica, titania and zinc stearate, during aging in the development housing. The presence of spacers can thus reduce such impaction and the negative effects associated therewith.

U.S. Pat. No. 5,763,132, incorporated herein by reference in its entirety, describes a process for decreasing toner adhesion and decreasing toner cohesion, which comprises adding a hard spacer component of a polymer of polymethyl methacrylate (PMMA), a metal, a metal oxide, a metal carbide, or a metal nitride, to the surface of a toner comprised of resin, wax, compatibilizer, and colorant excluding black, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above, 5 watts per gram of toner. See the Abstract and column 1, lines 9-28.

U.S. Pat. No. 5,716,752, incorporated herein by reference in its entirety, similarly describes a process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above, 5 watts per gram of toner. See the Abstract.

Thus, although the use of spacer particles upon the surface of toner particles is known, such spacer particles are typically hard particles that are attached to the toner particle surface by mechanical means such as fluid bed or jet milling. Both of the aforementioned references require that the spacers described therein be attached to the toner particles with high power injection in a fluid bed milling device during the size reduction (grinding) step, thereby requiring the use of hard spacer particles. Softer spacer type particles thus cannot be used in such attachment methods as they would be crushed or buried into the toner particles, and thus rendered ineffective for their intended purpose.

Recently, ultra large spacer particles, e.g., having a size of about 140 nm, have been added to a toner particle surface in a normal toner blending step. For example, after addition of smaller size additives by inject at grind as discussed above, such larger additives are added in a subsequent gentler toner blending process that is much less abusive than inject at grind. However, although this blending step is less abusive than the inject at grind procedure discussed above, the larger additives are not strongly adhered to the toner and can readily flake off and interfere with the quality of the image developed.

SUMMARY

Objects herein thus include deriving alternative methods for applying surface additive particles, e.g., spacer particles, to the surface of particles, e.g., toner particles, and deriving alternative surface particles for use as spacer particles upon the surfaces. These and other objects are achieved in the various embodiments described herein.

In one embodiment, the subject matter herein relates to a method of forming particles by aggregating a material comprised of at least one binder material and at least one colorant, introducing second particles having an average particle size of at least about 60 nm, and subjecting to a temperature above about the glass transition temperature of the particles, whereby the second particles become at least partially embedded within a surface of the particles.

In a further embodiment, the subject matter relates to particles, e.g., toner particles, comprising a core comprised of at least one binder and at least one colorant, and having, at a surface of the particles, second particles having an average particle size of at least about 60 nm, wherein at least about 50% of the second particles are substantially completely covered by binder of the particles and a majority of the second particles protrude from the surface of the particles a distance of at least 50% of the average particle size of the second particles.

Advantages include that the surface particles, which preferably act as spacers for the particles, are securely applied to the particles in a non-intensive manner. Various aspects described herein thus permit the use of inexpensive surface particles not previously capable of being used as spacers upon particles.

DETAILED DESCRIPTION OF EMBODIMENTS

Figure 1:
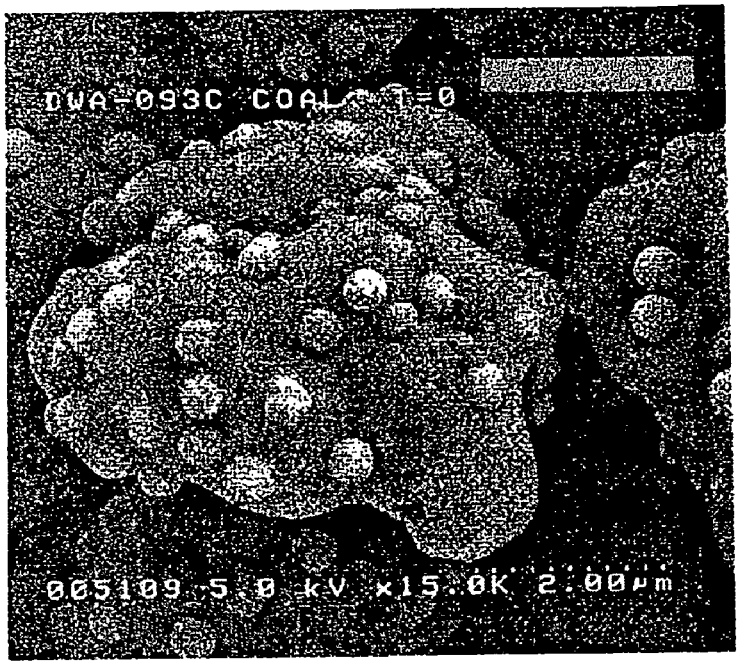
FIG. 1 is an SEM micrograph of surface particles upon toner particles prior to coalescence.

Emulsion/aggregation/coalescence processes for the preparation of toners are illustrated in a number of Xerox Corporation patents, the disclosures of each of which are totally incorporated herein by reference, such as U.S. Pat. Nos. 5,278,020, 5,290,654, 5,308,734, 5,344,738, 5,346,797, 5,348,832, 5,364,729, 5,366,841, 5,370,963, 5,403,693, 5,405,728, 5,418,108, 5,482,812, 5,496,676, 5,501,935, 5,527,658, 5,585,215, 5,622,806, 5,650,255, 5,650,256, 5,723,253, 5,744,520, 5,747,215, 5,763,133, 5,766,818, 5,804,349, 5,827,633, 5,840,462, 5,853,944, 5,863,698, 5,869,215, 5,902,710, 5,910,387, 5,916,725, 5,919,595, 5,922,501, 5,925,488, 5,945,245, 5,977,210, 6,210,853, 6,395,445, 6,503,680 and 6,627,373. The appropriate components and processes of the above Xerox Corporation patents can be selected for the various processes described herein.

Thus, as noted above, aggregation and coalescence techniques for forming toner particles are well known in the art, and any suitable aggregation step may be used without limitation. In the aggregation step, toner particles comprised of at least one binder and at least one colorant are grown to a desired, preferably predetermined, size, e.g., a size of from about 2 to about 15 microns, from small seed particles of the at least one binder. The starting seed binder particles employed in the aggregation step typically have an average particle size of less than 1 micron, e.g., an average size of from, for example, about 5 to about 500 nm and more preferably about 10 to about 250 nm in volume average diameter, as measured by any suitable device such as, for example, a NiComp sizer, although larger average sizes may also be used. The seed particles are preferably polymer materials, and may be formed by any suitable method, although it is preferred to form such polymer materials from starting monomers via the known emulsion polymerization method. Other processes of obtaining the resin seed particles can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

In a preferred method, the toner particles are derived in an emulsion aggregation process such as in any of the Xerox patents identified above. Broadly, such processes involve emulsion polymerization of polymerizable monomers, generating a latex of seed particles, and to the latex dispersion is added the at least one colorant along with other optional additives such as waxes, compatibilizers, releasing agents, coagulants, charge control additives, etc., and the dispersion is aggregated to the desired toner particle size, and then coalesced with heat to obtain the end toner particle.

At least one binder is desired in embodiments. Although any type of toner binder resin may be used, it is preferred to use copolymers of polystyrene and polybutylacrylate. Other resins, including polyacryaltes and polyesters generally, may also be applicable. The binder resins may be suitably used in the aforementioned emulsion aggregation processes to form toner particles of the desired size.

Illustrative examples of resins include polymers selected from the group including but not limited to: poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(para-methyl styrene-butadiene), poly(meta-methyl styrene-butadiene), poly(alpha-methyl styrene-butadiene), poly(para-methyl styrene-isoprene), poly(meta-methyl styrene-isoprene), poly(alpha-methyl styrene-isoprene), poly(methylacrylate-styrene), poly(ethylacryalte-styrene), poly(methylmethacrylate-styrene).

Further illustrative examples of resins include polyethylene-terephthalate, polypropylene-terephthalate, polybutylene-terephthalate, polypentylene-terephthalate, polyhexalene-terephthalate, polyheptadene-terephthalate, polyoctalene-terephthalate. Sulfonated polyesters such as sodio sulfonated polyesters as described in, for example, U.S. Pat. No. 5,593,807, may also be used. Additional resins, such as polyester resins, are as indicated herein and in the appropriate U.S. patents recited herein, and more specifically, examples further include copoly(1,2-propylene-dipropylene-5-sulfoisophthalate)-copoly(1,2-propylene-dipropylene terephthalate), copoly(1,2-propylene-diethylene-5-sulfoisophthalate)-copoly(1,2-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), and the like.

The resin particles selected for the process are preferably prepared from emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional. Crosslinking agents such as divinylbenzene or dimethacrylate and the like, can also be selected in the preparation of the emulsion polymer. Chain transfer agents, such as dodecanethiol or carbontetrachloride and the like, can also be selected when preparing resin particles by emulsion polymerization.

The resin particles selected, which generally can be in embodiments polystyrene homopolymers or copolymers, polyacrylates or polyesters, are present in various effective amounts, such as from about 50 weight percent to about 98 weight percent of the toner. Other effective amounts of resin can be selected.

At least one colorant, e.g., dyes and pigments, of any type may be used without limitation. Various known colorants, especially pigments, present in the toner in an effective amount of, for example, from about 1 to about 65, and more specifically, from about 2 to about 35 percent by weight of the toner, and yet more specifically, in an amount of from about 1 to about 15 weight percent, that may be used include carbon black like REGAL 330®, magnetites such as Mobay magnetites MO8029™, MO8060™, and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of specific cyans that may be selected include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like. Illustrative specific examples of yellows that may be selected are Diarylide Yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein. Colorant examples further include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, mixtures of dyes and pigments, and the like, and preferably pigments. Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions commercially available from Clariant include HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02, which can be dispersed in water and/or surfactant prior to use.

When the colorant is added with the polymer binder particles before aggregation, the colorant is preferably added as a dispersion of the colorant in an appropriate medium, i.e., a medium compatible or miscible with the latex emulsion including the polymer particles therein. Preferably, both the polymer binder and the colorant are in an aqueous medium.

As noted above, various optional additives may be included in the mixture of a latex emulsion of the toner binder resin and a colorant dispersion. Such additives may include additives relating to the aggregation process, for example surfactants to assist in the dispersion of the components or coagulants or other aggregating agents used to assist in the formation of the larger size toner particle aggregates. Such additives may also include additives for the toner core particle itself, e.g., waxes, charge controlling additives, etc. Any other additives may also be included in the dispersion for the aggregation phase, as desired or required.

Examples of waxes that can be selected for the processes and toners illustrated herein include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected possess, it is believed, a molecular weight $M_w$ of from about 500 to about 3,000, while the commercially available polypropylenes are believed to have a molecular weight of from about 4,000 to about 7,000. Examples of functionalized waxes include, such as amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical, Petrolite Corporation and SC Johnson Wax.

Illustrative examples of aggregating components or agents include zinc stearate; alkali earth metal or transition metal salts; alkali (II) salts, such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and the like. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts, such as aluminum acetate, polyaluminum chloride, aluminum halides, mixtures thereof, and the like. If present, the amount of aggregating agent selected can vary, and is, for example, from about 0.1 to about 10, and more specifically from about 1 to about 5 weight percent by weight of toner or by weight of water.

Once the binder, colorant and any additional additives have been added to the dispersion, the dispersion is subjected to aggregation to form the toner particles having a desired average particle size. Aggregation is preferably effected under continuous high shear conditions at a temperature below the glass transition temperature of the polymer of the binder. The high shear conditions are preferably effected with a mixing device. The shearing effects homogenization of the dispersion and permits the materials in the dispersion to aggregate, i.e., join and grow together. The dispersion may be homogenized with a high shearing device, such as a Brinkmann Polytron or IKA homogenizer, and further stirred with a mechanical stirrer, at a temperature of about 1° C. to about 40° C., below the glass transition temperature of the latex polymer. A preferred aggregation temperature in embodiments is, for example, about 35° C. to about 70° C.

The aggregation is continued, and the toner particle size monitored during aggregation, until toner particles of a desired particle size, e.g., of from about 2 to about 15 microns in average particle size, are achieved. Further aggregation may then be stopped by any means, e.g., by reducing the shear, or more preferably by altering the pH of the dispersion so that conditions for aggregation are no longer favorable, for example by adding a base such as sodium or ammonium hydroxide to the dispersion.

In a preferred embodiment, following aggregation of the particles including colorant therein, an additional latex emulsion containing substantially no colorant or waxes, and preferably free of colorant and waxes, is preferably introduced into the aggregated toner particle dispersion. The additional latex emulsion may be comprised of the same binder as in the aggregated toner particles, or may be a different polymer binder, e.g., a different polyester, polyacrylate and/or polystyrene binder; The purpose of the addition of this second latex emulsion is to deposit a thin shell or coating of preferably binder only material upon the aggregated toner particles. The second latex thus enables formation of a coating on the resulting toner aggregates, wherein the thickness of the formed coating is preferably less than 5 microns, for example from about 0.1 to about 1 micron. The shell or coating may be formed under the same conditions as the aggregation of the core toner particles. Further, multiple shell coatings may be applied.

Following the aggregation step, the temperature of the dispersion is preferably raised to above the glass transition temperature to effect coalescence of the toner particles. Coalescence has the effect of more completely forming the aggregated toner particles by, in a sense, melting the aggregated clumps to be more uniform. Following coalescence, the toner particles are more uniform and more round with less sharp edges. Coalescence is preferably effected for a period of about 1 to about 10 hours, preferably for about 1 to about 6 hours, more preferably from about 2 to about 5 hours, at a temperature above the glass transition temperature of the binder materials, for example at a temperature above the binder glass transition temperature by about 5° C. to about 50° C., preferably from about 10° C. to about 40° C. above the glass transition temperature of the binder. In preferred embodiments, the coalescence temperature is from about 80° C. to about 130° C., preferably from about 80° C. to about 100° C.

Prior to or during the coalescing step, surface additive particles, i.e., surface spacer particles, are introduced into the mixture containing the aggregated toner particles. The spacer particles preferably have a glass transition temperature above the glass transition temperature of the toner binder, and preferably higher than the coalescing temperature, so that the spacer particles are not substantially melted during the coalescence step. Following introduction of the spacer particles, coalescing of the toner particles is continued as discussed above.

The surface spacer particles are thus added in-situ during the formation of the toner particles. Doing so permits the surface additive particles to be more firmly adhered to the toner particle. The spacer particles essentially become physically embedded in the surface of the toner particles, thereby establishing a strong physical bond between the toner and spacer particles. During coalescence, the spacer particles embed into the softened toner particle surface. Preferably, coalescence is continued until at least about 50%, preferably at least about 70%, of the surface additive particles are substantially completely covered by at least a portion of a binder material of the toner. However, the spacer particles still protrude from the surface of the toner particles so as to affect the desired spacing functions discussed herein. In a preferred embodiment, a majority (i.e., more than 50%) of the surface additive particles protrude from the surface of the toner particles a distance of at least about 50% of the average size of the surface additive particles.

Figure 2:
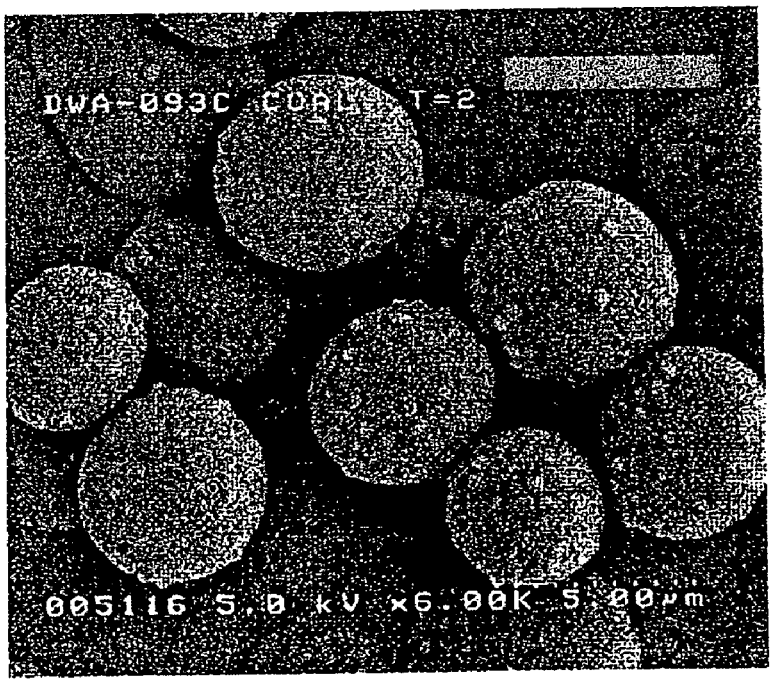
FIG. 2 is an SEM micrograph of the same surface particles upon toner particles after 2 hours of coalescence.
Figure 3:
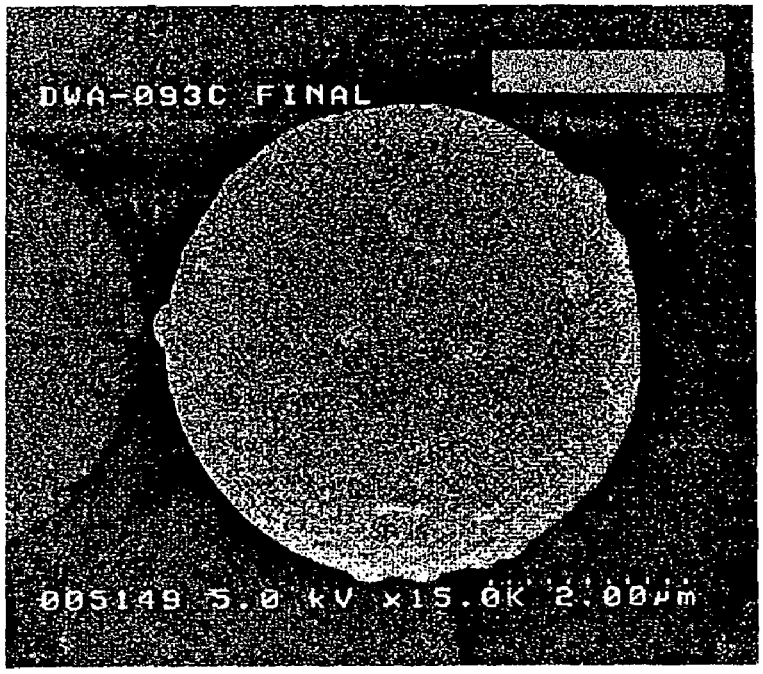
FIG. 3 is an SEM micrograph of the same surface particles upon toner particles after 4 hours of coalescence.
Figure 4:
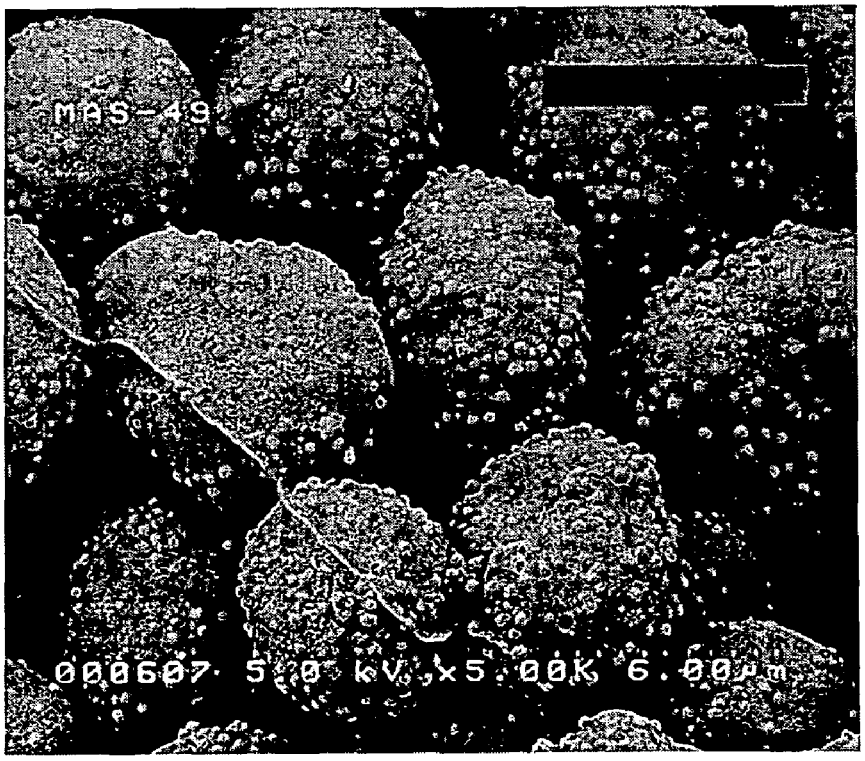
FIG. 4 is an SEM micrograph of a styrene/butylacrylate toner with incorporated alkyl tri-alkoxy-silane particles after coalescence.
Figure 5:
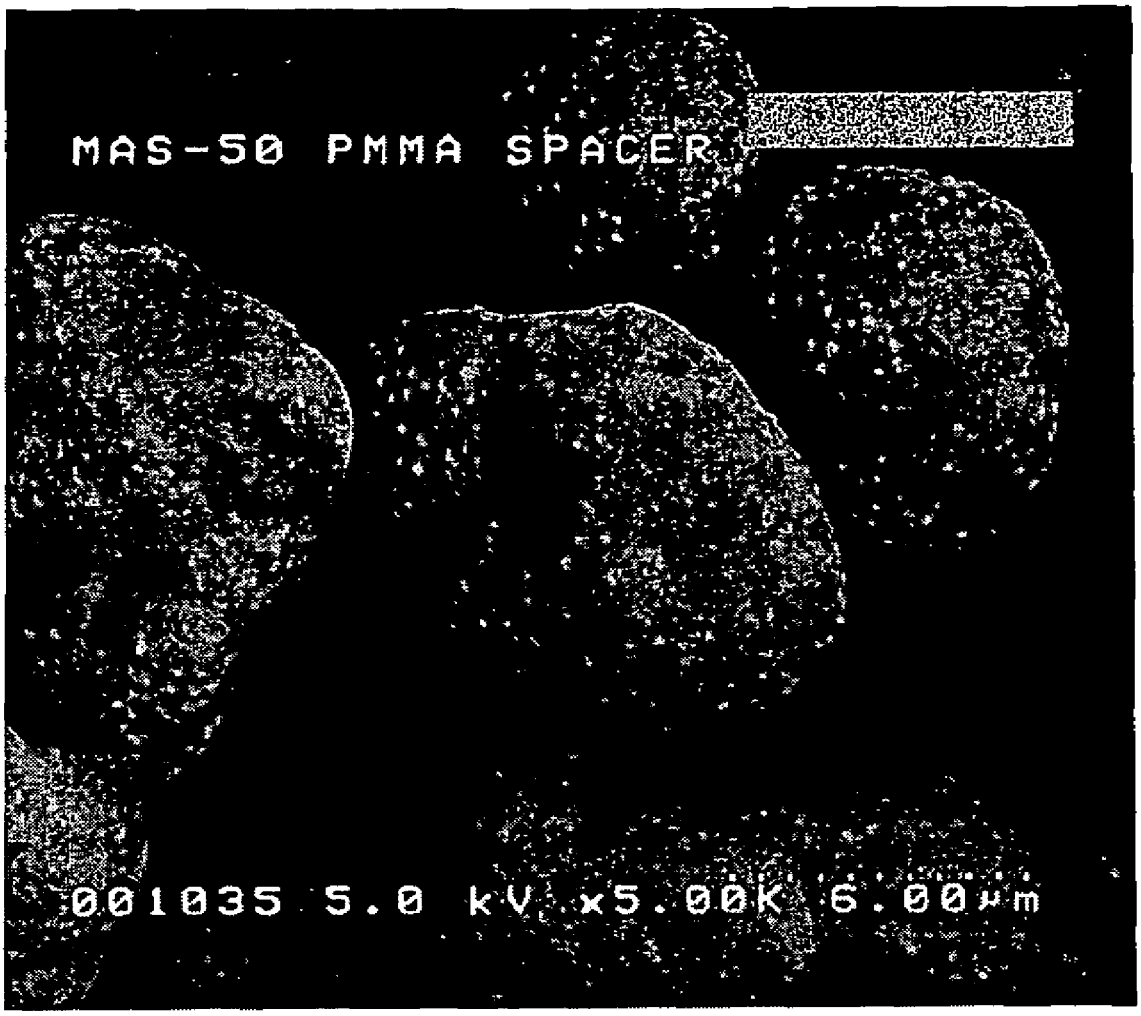
FIG. 5 is an SEM micrograph of a styrene/butylacrylate toner with incorporated polymethylmethacrylate spacer particles after coalescence.

The physical attachment and protrusion of the surface additive particles is illustrated in FIGS. 1-5. FIG. 1 is a SEM micrograph of an aggregated toner particle to which surface additive particles have been adhered, but prior to any coalescing. FIG. 2 is an SEM micrograph of the same toner particle after 2 hours of coalescence, while FIG. 3 is the same toner after 4 hours of coalescence. FIG. 4 is an SEM micrograph of a styrene/butylacrylate toner with incorporated alkyl tri-alkoxy-silane particles after coalescence. FIG. 5 is an SEM micrograph of a styrene/butylacrylate toner with incorporated polymethylmethacrylate spacer particles after coalescence. As can be seen, the surface additive particles become embedded in the toner particle surface while still protruding sufficiently there from.

The surface additives added to the toner particles in-situ during formation thereof preferably have a size suitable to perform as spacers upon the toner particle surface. In preferred embodiments, the surface additives have an average particle size of from about 60 nm to about 1000 nm, preferably from about 100 nm to about 500 nm or from about 250 nm to about 500 nm, more preferably from about 300 nm to about 500 nm. The surface additive particles added in situ may be included with the toner particles in an amount of from, for example, about 0.1% by weight to about 20% by weight, preferably from about 1% by weight to about 10% by weight, and most preferably 1% by weight to about 6% by weight, of the toner particles.

In embodiments, the spacer particles are of a type that is not suitable for attachment, or that so not adequately adhere, to the toner particles with high power injection in a fluid bed milling device during the size reduction (grinding) step or with the less energy intensive post-toner formation dry blending process. That is, the polymer particles may be of a softer (e.g., lower melting point and/or less crosslinked) material that would be destroyed if attempted to be attached via high power injection in a fluid bed milling device. In addition, the dry blending additive process is limited in capability to attach additives much larger than 200 nm. Additive attachment falls off rapidly with additive size, and dry blending becomes ineffective above 200 nm. In addition, the polymer particles may be chosen to impart a specific triboelectric charge to the toner particle based on the surface energy of the polymer particle.

In a further aspect, in particular the aspect relating to the method of application of the spacer particles to the toner particles, the spacer particles may also comprise polymer particles. Any type of polymer may be used to form the spacer particles of this embodiment. As examples, the spacer particles may include acrylic, styrene and its derivatives, styrene acrylates, fluorinated polymers, crystalline or amorphous polyester, methacrylates and its derivatives, cyclic olefin polymers, and copolymers, elastomeric materials, or mixtures thereof. Specific examples include acrylic, styrene acrylic and fluorinated latexes from Nippon Paint (e.g., E-104, FS-101, FS-102, FS-104, FS-201; FS-401, FS-451, FS-501, FS-701, MG-151 and MG-152). Further specific examples are discussed below.

In preferred embodiments, the surface spacer particles are synthetic materials, e.g., polymeric materials, more preferably selected from the group consisting of alkyl trialkoxysilanes, polystyrene, polymethyl methacrylate, and copolymers of styrene/acrylate.

As the alkyl trialkoxysilanes, the alkyl may have a chain length of from, for example, 1 to 10 C atoms, and the alkoxy may likewise have a chain length of from 1 to 10 C atoms. A preferred alkyl group is methyl or ethyl and a preferred alkoxy group is methoxy or ethoxy. Preferably, the alkyl trialkoxysilane may be methyl trimethoxysilane. A commercially available alkyl trialkoxysilane is TOSPEARL™, a polymethyl silsesquioxane available from GE Silicones. The alkyl trialkoxysilane is dispersed in any suitable medium, preferably aqueous, using a dispersant such as sodium lauryl sulfate, and incorporated onto the surface of the toner particles during aggregation/coalescence as discussed above.

The preferred alkyl tri-alkoxy-silane having the silsesquioxane structure is preferably prepared by reacting an alkyl silane, for example a trifunctional alkyl silane such as $MeSi(OR)_3$ (wherein R is an alkyl group, preferably methyl) at the silane/water base interface. As the silane hydrolyzes, it becomes soluble at the interface, where it undergoes condensation, forming and growing into a spherical particle. As the particle grows, it becomes insoluble and precipitates. The particles may then be isolated and dried, and broken up to suitable sizes, for example by jet milling. An advantage herein is that the resulting particles may be dispersed with surfactant in aqueous medium, thus maintaining their primary particle size, and then be attached in situ while still dispersed.

While the use of an alkyl tri-alkoxy-silane spacer particle upon the surface of the toner particles may lower the triboelectric charge of the toner particles, the addition of conventional surface additives to adjust the triboelectric charge may be made to counteract this effect. The resulting toner particles thus have a similar triboelectric charge but a much better resistance to reduction in performance properties due to aging in the developer housing. The toner particles having the surface spacer particles attached thereto also exhibit a much lower percentage of wrong sign and/or low charge toner upon admixing. Thus, addition of the surface spacer particles better protects the toner particles from physical abuse in the housing and will not adversely impact the charge of the toner upon addition of conventional surface additives.

In another preferred embodiment, the surface spacer particles are comprised of polystyrene particles, including homopolymers and copolymers thereof.

The polymer may also be polymethyl methacrylate (PMMA), e.g., 150 nm MP1451 or 300 nm MP116 from Soken Chemical Engineering Co., Ltd. with molecular weights between 500 and 1500K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

With the use of a PMMA surface spacer additive, it has been found that the triboelectric charge for the toner particles is initially higher when such spacer additives are used. However, this again may be readily adjusted through the use of conventional surface additives as discussed above. However, the additional benefit here is that the amount of conventional surface additives required to adjust the triboelectric charge to the desired value may be reduced, resulting in a cost savings.

The surface spacer particles may also be comprised of inorganic materials such as titania, alumina, or any other inorganic particle within the above-mentioned size ranges that may function as a spacer upon the surface of the toner particles.

The polymer particle spacers on the surfaces of the toner particles of the toner composition are believed to function to reduce toner cohesion, stabilize the toner transfer efficiency, reduce/minimize development falloff characteristics associated with toner aging, and stabilize triboelectric charging characteristics and charge through. These external additive particles have the aforementioned ultra large particle size and are present on the surface of the toner particles, thereby functioning as spacers between the toner particles and carrier particles and hence reducing the impaction of smaller conventional toner external surface additives having a size of from, for example, about 8 to about 40 nm, such as silica, titania and/or zinc stearate, during aging in the development housing. The spacers thus stabilize developers against disadvantageous burial of conventional smaller sized toner external additives by the development housing during the imaging process in the development system. The ultra large external additives, such as latex and polymer particles, function as a spacer-type barrier, and therefore the smaller conventional toner external additives of, for example, silica, titania and zinc stearate, are shielded from contact forces that have a tendency to embed them in the surface of the toner particles. The ultra large external additive particles thus provide a barrier and reduce the burial of smaller sized toner external surface additives, thereby rendering a developer with improved flow stability and hence excellent development and transfer stability during copying/printing in xerographic imaging processes. The toner compositions exhibit an improved ability to maintain their DMA (developed mass per area on a photoreceptor), their TMA (transferred mass per area from a photoreceptor) and acceptable triboelectric charging characteristics and admix performance for an extended number of imaging cycles.

In addition, the toner particles also preferably include one or more external additive particles. Such external surface additives may be added to the toner particles after isolation by, for example, filtration, and then optionally followed by washing and drying. Suitable external surface additives include, for example, metal salts, metal salts of fatty acids, colloidal silicas, titanium oxides, mixtures thereof, and the like, reference U.S. Pat. Nos. 3,590,000, 3,720,617, 3,655,374 and 3,983,045, the disclosures of which are totally incorporated herein by reference. Preferred additives include zinc stearate, silicas, such as AEROSIL R972™, and other silicas.

As the external surface additives, most preferred are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate, magnesium stearate) or long chain alcohols such as UNILIN 700, as external surface additives. In general, silica is applied to the toner surface for, e.g., toner flow, tribo enhancement, admix control, improved development and transfer stability and higher toner blocking temperature. $TiO_2$ is applied for, e.g., reduced RH sensitivity of charging, tribo control and improved development and transfer stability.

The external surface additives preferably have a primary particle size of from about 5 nm to about 40 nm, preferably about 8 nm to about 40 nm as measured by, for instance, scanning electron microscopy (SEM) or calculated (assuming spherical particles) from a measurement of the gas absorption, or BET, surface area.

The most preferred $SiO_2$ and $TiO_2$ external additives have been surface treated with compounds including DTMS (decyltrimethoxysilane) or HMDS (hexamethyldisilazane). Examples of these additives are: NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP silica, obtained from Wacker Chemie, coated with an amino functionalized organopolysiloxane; TS530 from Cabot Corporation, Cab-O-Sil Division, a treated fumed silica; SMT5103 titania, obtained from Tayca Corporation, comprised of a crystalline titanium dioxide core MT500B, coated with DTMS.; MT3103 titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive for the toners, the zinc stearate providing lubricating properties. Zinc stearate provides, for example, developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. A commercially available zinc stearate known as ZINC STEARATE L, obtained from Ferro Corporation, which has an average particle diameter of about 9 microns as measured in a Coulter counter, may be suitably used.

Each of the external additives present may be present in an amount of from, for example, about 0.1 to about 8 percent by weight of the toner composition. Preferably, the toners contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, about 0.1 to 6 weight percent silica and about 0.1 to 3 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the charging characteristics of the developer compositions described herein, and as optional components there can be incorporated into the toner or on its surface negative charge enhancing additives inclusive of aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

Once the toner particles are formed, developer compositions may then be formed employing the toner particles. For the formulation of developer compositions, carrier components, e.g., carrier particles, are mixed with the toner particles, particularly carrier components that are capable of triboelectrically assuming an opposite polarity to that of the toner composition. For example, the carrier particles may be selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in, for example, U.S. Pat. No. 3,847,604. The selected carrier particles can be used with or without a coating of any desired and/or suitable type. The carrier particles may also include in the coating, which coating can be present in one embodiment in an amount of from about 0.1 to about 5 weight percent, conductive substances such as carbon black in an amount of from about 5 to about 30 percent by weight and/or insulative substances such as melamine in an amount from about 5 to about 15 percent by weight. Polymer coatings not in close proximity in the triboelectric series may be selected as the coating, including, for example, KYNAR® and polymethylmethacrylate mixtures. Coating weights can vary as indicated herein; generally, however, from about 0.3 to about 2, and preferably from about 0.5 to about 1.5 weight percent coating weight is selected.

The diameter of the carrier particles, preferably spherical in shape, is generally from about 35 microns to about 500, and preferably from about 35 to about 100 microns, thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

EXAMPLE 1

In this Example, a styrene/butyl acrylate resin was employed as a toner binder in forming toner particles having an average particle size of 5.8 microns, and styrene/acrylate surface spacer particles having a size of from 400 to 500 nm thereon.

A starting emulsion of the resin particles as latex (284 g at 40% solids), pigment (42 g at 23% solids), wax dispersion (54 g at 40% solids) and a small amount of poly aluminum chloride was initially homogenized in an IKA/T50 homongenizer at 4000 rpm for 10 minutes. The emulsion included an aqueous base (555 g).

Aggregation was then commenced, the temperature of the reactor being set to 55° C., stirring being continued. During aggregation, the pH is approximately 2.4. Aggregation was stopped after about 63 minutes from the start of aggregation. At that time 30 g of styrene/butylacrylate latex was added to form a shell upon the aggregated particles. These conditions were maintained for about 6 minutes.

At approximately 80 minutes from the start of aggregation, a further 30 g of styrene/butylacrylate latex was added along with 50 g of the stryrene/acrylate particles. Approximately 10 minutes after this addition, the pH was adjusted up to about 7. At that time stirring was reduced to about 100 rpm and the temperature of the reactor raised to about 98° C. The particles were then allowed to coalesce at a temperature of about 97.5° C. until about 385 minutes of time elapsed from the start of aggregation. At that time the reactor temperature was reduced to 54 C, the pH was adjusted to about 8.0, held for 20 minutes then washed and dried. Toner particles having an appearance similar to that shown in FIG. 3 were obtained.

EXAMPLE 2

The following materials were charged into a two gallon reactor: 648 g styrene/butylacrylate latex, 84 g Pigment blue 15:3, and 1.6 g poly aluminum chloride. These materials were homogenized for 6 minutes, then aggregated for 69 minutes as in Example 1. 70 g of styrene/acrylate shell was added over 4 minutes. At 81 minutes, a second shell (70 gm) was mixed with a dispersion of alkyl tri-alkoxy-silane particles (590 nm) (95 g at 6% solids), then added to the aggregate over 10 minutes. The mixture was grown to 9.7 micron particle size, then frozen with addition of base at 123 minutes. The initial pH of about 2.3 was adjusted up to about 4.95, and the particles coalesced for 4 hours at 95 to 100° C. The mixture was later pH adjusted to about 8.0, then washed and dried. Toner particles having an appearance similar to that shown in FIG. 4 were obtained.

EXAMPLE 3

The following materials were charged into a two gallon reactor: 648 g styrene/butylacrylate latex, 84 g Pigment blue 15:3 and 1.2 g poly aluminum chloride. These materials were homogenized for 6 minutes, then aggregated for 69 minutes as in Example 1. 70 g of styrene/acrylate shell was added over 4 minutes. At 81 minutes, a second shell (70 gm) was mixed with a dispersion of PMMA spacer particles (135 g at 12% solids), then added to the aggregate over 12 minutes. The mixture was grown to 9.28 micron particle size, then frozen with addition of base at 103 minutes. The initial pH of about 2.36 was adjusted up to about 4.9 and, and the particles coalesced for 4 hours at 95 to 100° C. The mixture was later pH adjusted to about 9.6, then washed and dried. Toner particles having an appearance similar to that shown in FIG. 5 were obtained.

The toner and developer compositions can be selected for electrophotographic, especially xerographic, imaging and printing processes, including digital processes. The toners may be used with particular advantage in image development systems employing hybrid scavengeless development (HSD) in which an aggressive developer housing is employed that has a tendency to beat conventional smaller sized external surface additives into the surface of the toner particles, thereby causing the toner properties to degrade upon aging. Of course, the toner may be used in an image development system employing any type of development scheme without limitation, including, for example, conductive magnetic brush development (CMB), which uses a conductive carrier, insulative magnetic brush development (IMB), which uses an insulated carrier, semiconductive magnetic brush development (SCMB), which uses a semiconductive carrier, etc.

While various embodiments have been described above, it is evident that many alternatives, modifications and variations will be apparent to those skilled in the art. Accordingly, the embodiments, as set forth above, are intended to be illustrative and not limiting. Various changes may be made without departing from the spirit and scope of the invention.

What is claimed is:

1. A method comprising forming particles by aggregating a material comprised of at least one binder material and at least one colorant, introducing second particles having an average particle size of at least about 60 nm, and subjecting to a temperature above about the glass transition temperature of the particles, whereby the second particles become at least partially embedded within a surface of the particles, wherein the aggregating comprises growing particles to an average particle size of from about 2 microns to about 15 microns.

2. The method according to claim 1, wherein the material comprises an emulsion of at least one binder material and at least one colorant.

3. The method according to claim 1, wherein following forming the particles and before introducing the second particles, the method further comprises forming a shell comprised of at least one second binder material upon the surface of the particles.

4. The method according to claim 3, wherein the shell is substantially free of colorant.

5. The method according to claim 3, wherein the at least one second binder material is the same as the at least one binder material.

6. The method according to claim 1, wherein the temperature above the glass transition temperature of the particles is from about 80° C. to about 130° C.

7. The method according to claim 1, wherein the temperature above the glass transition temperature of the particles is below a melting temperature of the second particles.

8. The method according to claim 1, wherein the subjecting to a temperature above the glass transition temperature of the particles is conducted for about 1 to about 6 hours.

9. The method according to claim 1, wherein the second particles have an average particle size of from about 60 nm to about 1000 nm.

10. The method according to claim 1, wherein the second particles have an average particle size of from about 60 nm to about 500 nm.

11. Toner particles comprising a core comprised of at least one binder and at least one colorant, and having, at a surface of the particles, second particles having an average particle size of at least about 60 nm, wherein at least about 50% of the second particles are substantially completely covered by binder of the particles and a majority of the second particles protrude from the surface of the particles a distance of at least 50% of the average particle size of the second particles.

12. The particles according to claim 11, wherein the particles have an average particle size of from about 2 microns to about 15 microns.

13. The particles according to claim 11, wherein the second particles have an average particle size of from about 60 nm to about 1000 nm.

14. The particles according to claim 11, wherein the second particles have an average particle size of from about 60 nm to about 500 nm.

15. The particles according to claim 11, wherein the particles further comprise additional additives selected from the group consisting of silica, titania, zinc, calcium stearate or magnesium stearate, and mixtures thereof, each having an average particle size of from about 8 nm to about 40 nm, on the surface of the particles.

16. The particles according to claim 11, wherein the second particles are selected from the group consisting of alkyl trialkoxysilanes, styrene, polymethyl methacrylate and styrene/acrylate copolymers.

17. The particles according to claim 11, wherein the particles are emulsion aggregation particles in which the at least one binder is selected from the group consisting of polyesters, polystyrene homopolymers and copolymers, and polyacrylates.

18. The particles according to claim 11, wherein the binder covering the second particles is from a shell of the particles.

19. A developer comprising a mixture of toner particles and carrier particles, wherein the toner particles comprise a core comprised of at least one binder and at least one colorant, and having, at a surface of the toner particles, second particles having an average particle size of at least about 60 nm, wherein at least about 50% of the second particles are substantially completely covered by binder of the toner particles and a majority of the second particles protrude from the surface of the toner particles a distance of at least 50% of the average particle size of the second particles.

* * * * *